US009754747B1

(12) United States Patent
Yeh

(10) Patent No.: US 9,754,747 B1
(45) Date of Patent: Sep. 5, 2017

(54) RELAY DEVICE

(71) Applicant: SONG CHUAN PRECISION CO., LTD., New Taipei (TW)

(72) Inventor: Chia-Shen Yeh, New Taipei (TW)

(73) Assignee: Song Chuan Precision Co., Ltd., New Taipei (TW)

( * ) Notice: Subject to any disclaimer, the term of this patent is extended or adjusted under 35 U.S.C. 154(b) by 0 days.

(21) Appl. No.: 15/136,993

(22) Filed: Apr. 25, 2016

(51) Int. Cl.
*H01H 51/22* (2006.01)
*H01H 50/04* (2006.01)

(52) U.S. Cl.
CPC ..... *H01H 50/047* (2013.01)

(58) Field of Classification Search
CPC ..... H01H 51/22; H01H 9/00; H01H 67/102; H01H 50/04; H01H 50/14
USPC ..... 335/178
See application file for complete search history.

(56) References Cited

U.S. PATENT DOCUMENTS 3,017,474 A * 1/1962 Huetten ..... H01H 50/20 335/179
4,403,203 A * 9/1983 Schedele ..... H01H 51/2254 335/179
4,731,597 A * 3/1988 Hinrichs ..... H01H 50/026 335/128
4,758,809 A * 7/1988 Bell ..... H01H 50/28 335/128
5,394,127 A * 2/1995 Hendel ..... H01H 50/54 335/128
5,781,089 A * 7/1998 Doneghue ..... H01H 50/026 335/128
5,889,451 A * 3/1999 Kern ..... H01H 50/54 335/128
5,889,454 A * 3/1999 Hendel ..... H01H 50/36 335/177
5,894,253 A * 4/1999 Ichikawa ..... H01H 50/042 335/78
5,929,730 A * 7/1999 Hendel ..... H01H 49/00 335/128
6,075,429 A * 6/2000 Uotome ..... H01H 50/645 335/129
6,225,880 B1 * 5/2001 Kern ..... H01H 49/00 335/159
7,116,193 B2 * 10/2006 Campbell ..... H01H 50/16 335/128
7,283,026 B2 * 10/2007 Nakamura ..... H01H 50/043 335/202
7,659,800 B2 * 2/2010 Gruner ..... H01H 1/26 335/185

(Continued)

*Primary Examiner* — Shawki S Ismail
*Assistant Examiner* — Lisa Homza
(74) *Attorney, Agent, or Firm* — Rosenberg, Klein & Lee

(57) ABSTRACT

A relay device comprises a base, a pin, and an outer cap. A gap is arranged at a peripheral of the base. The pin has a convex plate and assembled to the gap of the base and one end thereof is protruded from the gap. The convex plate is covered/shielded the gap. The outer cap includes a receiving groove. A notch of the receiving groove is covered the base and the pin. A paste is applied among the peripheral of the base, the convex plate of the pin, and the notch of the receiving groove for fastening. The gap arranged at the peripheral of the base is providing the pin for assembling without directional limitation and advantageous to once assembly of the base and the pin in an automatic machine so as to simplify the manufacturing process of the relay device.

1 Claim, 7 Drawing Sheets

(56) References Cited

U.S. PATENT DOCUMENTS

2005/0057332 A1* 3/2005 Nakamura ..... H01H 50/042
335/128

* cited by examiner

RELAY DEVICE

BACKGROUND OF THE INVENTION

1. Field of the Invention

The present invention relates to an electronic control member, and especially relates to a relay device.

2. Description of Related Art

The relay is one kind of the control elements in life. When some condition is satisfied, the control relay may be short or open and further used for protection in automatic control. The relay device is applied widely. There are many kinds of relay devices for selection, such as reed relays used for the safety system of communication and testing, high-voltage relay used for high-voltage measurement, medical and diagnostic equipment, and cable tester, automotive relay used for the circuit board or quick coupling of automotive equipment, or circuit board type used for communication/electronic devices, automatic control equipment, and appliances and being capable for mounting on any kind of circuit board.

The Applicant of this invention has invested a lot of time to study the relevant knowledge, compare the pros and cons, research and develop related products. There are many patents pending and issued. After quite many experiments and tests, the "relay device" of this invention is eventually launched to improve the foregoing shortcomings, to meet the public use.

Please reference to Taiwanese patent no. TWM410325 (hereafter '325), it disclosed a relay assembly. The relay assembly comprises a reel, an iron core assembled to the reel, and a bracket assembled to the reel. The reel includes a receiving hole. The iron core is assembled to the receiving hole. A plurality of press-fit portions is arranged around a peripheral of the iron core and abutted against the receiving hole. A gap is formed between two adjacent press-fit portions. An outer diameter of the iron core including the press-fit portions is larger than an inner diameter of the receiving hole. The bracket is assembled between two ends of the reel. Therefore, it may quickly assemble the iron core to the reel for fastening in a single direction and then advantageous to an automatic machine for quick assembly so as to achieve the effect of saving manufacturing time.

However, although the structure of the U.S. Pat. No. '325 is mentioned that it may quickly assemble the iron core to the reel for fastening in a single direction and then advantageous to an automatic machine for quick assembly, the assembly of the bracket may influence/hinder the automatic machine from once assembly due to the direction of assembly. Please reference to the U.S. Pat. No. '325 and the following numerals are corresponding and referenced to the U.S. Pat. No. '325. The U.S. Pat. No. '325 is disclosed that "The bracket (numbered as 3) is L-shaped element. Two sides of one end of the bracket are respectively arranged a hinge block capable for inversely hinging a barbed portion (numbered as 132). The top-end base (numbered as 12) includes an inner groove (numbered as 121). The other end of the bracket (numbered as 3) is assembled to and positioned in the inner groove (numbered as 121). The tail end of the iron core (numbered as 2) is exposed to the inner groove (numbered as 121). The bracket (numbered as 3) includes a through hole (numbered as 32) for covering and fastening to the tail end of the iron core (numbered as 2). A punch hole (numbered as 133) is formed at bottom of the opening of the lateral slot (numbered as 131) of the bottom-end base (numbered as 13). The bracket (numbered as 3) includes a punch pin (numbered as 33) for passing through the punch hole (numbered as 133). An L-shaped middle elastic plate (numbered as 41) is assembled to the tail end of the bracket (numbered as 3). An electrode (numbered as 42) is assembled to one end of the middle elastic plate (numbered as 41). The end of the middle elastic plate (numbered as 41) assembled to the electrode (numbered as 42) is arranged in the lateral slot (numbered as 131) of the bottom-end base (numbered as 13). The electrode (numbered as 42) is located at side of the tail end of the iron core (numbered as 2). A pin (numbered as 43) extended outwardly is assembled in the lateral slot (numbered as 131)." Because "The end of the middle elastic plate (numbered as 41) assembled to the electrode (numbered as 42) is arranged in the lateral slot (numbered as 131) of the bottom-end base (numbered as 13)", the middle elastic plate (numbered as 41) must laterally assembled to the lateral slot (numbered as 13) of the bottom-end base (numbered as 13) first and then the punch pin (numbered as 33) of the bracket (numbered as 3) is longitudinally inserted into the punch hole (numbered as 133). Therefore, the bracket (numbered as 3) is truly not performed once assembly in the automatic machine so that the assembling/manufacturing process is more complicated and inconvenient. It needs to be improved.

Please refer to FIG. 7, it shows a respective view of a conventional relay device. The conventional relay device comprises a base 100. An electromagnetic coil 101 is arranged at a center of the base 100 and a lateral slot 102 is arranged at one side of the electromagnetic coil 101. The lateral slot 102 is providing an L-shaped electrode 103 for laterally assembling to a lower end of the electromagnetic coil 101. A punch hole 104 is further formed at an outer side of the lateral slot 102 of the base 100. The punch hole 104 is providing a splicing end of a pin 105 for longitudinally splicing in the punch hole 104. And a control section bent and extended from a upper section of the pin 105 is assembled to a magnetic control portion 106 corresponding to the upper end of the electromagnetic coil 101. Because the electrode 103 is laterally assembled to the lower end of the lower end of the electromagnetic coil 101 and the pin 105 is limited to longitudinally insert into the punch hole 104, the assembling directions are different before and after processing so that once assembly is hard to be performed. Therefore, the assembling/manufacturing process becomes complicated and inconvenient.

In conclusion, the drawbacks of the relay device/assembly are summarized as follows.

Firstly, the assembling direction of the pin is limited by the assembly of splicing the pin into the punch hole of the base so that the assembling directions are different before and after processing and once assembly is hard to be performed. Therefore, the assembling/manufacturing process becomes complicated and inconvenient.

Secondly, because the manufacturing issues/troubles is caused by once assembly being hard to be performed in the automatic machine with the pin, the process time may be delayed and the cost is increased.

Therefore, the above summarized drawbacks of the relay device/assembly must be improved and solved.

SUMMARY OF THE INVENTION

A main object of this invention is providing a relay device. The gap arranged at a peripheral of the base is providing the pin for assembling without directional limitation and is advantageous to once assembly of the base and the pin in the automatic machine so as to effectively simplify the manufacturing process of the relay device.

Another object of this invention is providing a relay device. It may further simplify the manufacturing process and precisely control the manufacturing time so as to effectively reduce the manufacturing cost and achieve the economic benefit.

In order to achieve above mentioned objects, a relay device comprises a base, having a gap; and a pin, having a convex plate, the pin is assembled to the gap of the base and one end thereof is protruded from the gap, and the convex plate covers the gap.

Preferably, the base is combined with an electromagnet and a control mount, the electromagnet includes a magnetic end and one end arranged distant from the base, the control mount has a control portion the control mount is covered the magnetic end, the control portion includes an upper connection sheet and a lower connection pad, and the lower connection pad is connected with a lower side of the upper connection sheet.

Preferably, the pin further includes a bent section extended toward the base, the bent section has a magnetic sheet corresponding to the magnetic end and a free connection pad arranged between the upper connection sheet and the lower connection pad, the free connection pad is elastically abutted against the upper connection sheet, the magnetic end is magnetically abutted against and released from the corresponding magnetic sheet of the bent section so that the free connection pad is abutted against or left from the lower connection pad.

Preferably, the relay device further comprises an outer cap, the outer cap includes a receiving groove, the receiving groove is covered the base and packaged parts of the pin, and the convex plate covers the gap to isolate and protect an inner side of the receiving grove.

Preferably, a paste is applied between an inner wall of the receiving groove and a peripheral of the base and between the gap and the convex plate of the pin for fastening.

In order to achieve above mentioned objects, another one relay device comprises a base, having a gap arranged at a peripheral thereof, the base is combined with a electromagnet and a control mount, the electromagnet has a magnetic end and one end arranged distant from the base, the control mount has a covering hole and a control portion, the covering hole of the control mount is covered the magnetic end, the control portion includes an upper connection sheet and a lower connection pad, the lower connection pad is connected to a lower side of the upper connection sheet, and the lower connection pad is connected with a second pin; a pin, having a convex plate, the pin is assembled to the gap of the base and one end thereof is protruded from the gap, the convex plate is covered the gap, the pin includes a bent section extended toward the control mount, the bent section has a magnetic sheet corresponding to the magnetic end and a free connection pad arranged between the upper connection sheet and the lower connection pad, the bent section has a bending elasticity so that the free connection pad is elastically abutted against the upper connection sheet, the magnetic end is magnetically abutted against the magnetic sheet of the bent section so that the free connection pad is abutted against the lower connection pad and electrically connected with a circuit via the second pin; and an outer cap, having a receiving groove, the receiving groove is covered the base and packaged parts of the pin, and a paste is applied between an inner wall of the receiving groove and a peripheral of the base and between the gap and the convex plate of the pin for fastening.

The various objects and advantages of the present invention will be more readily understood from the following detailed description when read in conjunction with the appended drawing.

DETAILED DESCRIPTION OF THE INVENTION

Figure 1:
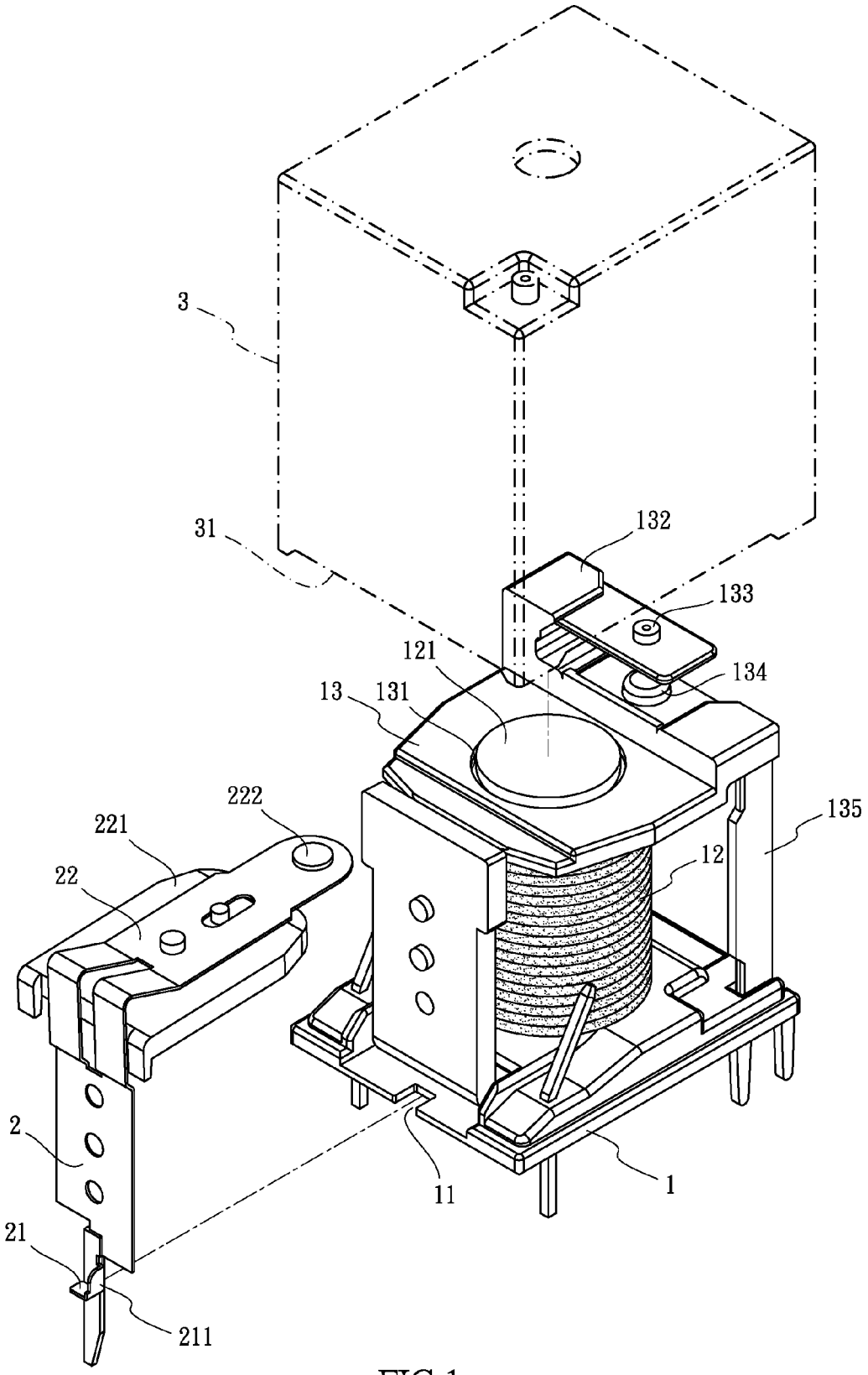
FIG. 1 is an exploded view of a relay device of the present invention.

To describe clearly that the present invention achieves the foregoing object and function, the technical features and desired function are described with reference to a preferred embodiment and accompanying drawings.

Please reference to FIGS. 1 to 5, a relay device may comprise a base 1 and a pin 2. The base 1 has a gap 11 arranged at a peripheral thereof. The pin 2 has a convex plate 21. The pin 2 is assembled to the gap 11 of the base 1 and one end thereof is protruded from the gap 11. The convex plate 21 is covered the gap 11.

The above mentioned embodiment is the main skill feature of this invention and corresponds to the claim 1 of this invention to understand the object and embodiments of this invention in detail. And the skill features of the depending claims are for describing the claim 1 in detail or adding more skill features, but not limited thereto. It should be known that the claim 1 is not necessary to include the skill features of the depending claims.

According to above descriptions, please also refer to FIGS. 1 to 5, the base 1 may be combined with an electromagnet 12 and a control mount 13. The electromagnet 12 has a magnetic end 121 and one end arranged distant from the base 1. The control mount 13 has a control portion 132. The control mount 13 is covered the magnetic end 121. The control portion 132 includes an upper connection sheet 133 and a lower connection pad 134. The lower connection pad 134 is arranged at and connected with a lower side of the upper connection sheet 133. Furthermore, the pin 2 further includes a bent section 22 extended toward the control mount 13. The bent section 22 has a magnetic sheet 221 corresponding to the magnetic end 121 and a free connection pad 222 arranged between the upper connection sheet 133 and the lower connection pad 134. The free connection pad 222 is elastically abutted against the upper connection sheet 133. The magnetic end 121 is magnetically abutted against and released from the magnetic sheet 221 of the bent section 22 so that the free connection pad 222 is abutted against or left from the lower connection pad 134. In addition, the relay device further comprises an outer cap 3. The outer cap 3 includes a receiving groove 31. The receiving groove 32 of the outer cap 3 is covered the base 1 and packaged parts of the pin 2. The convex plate 21 is covered/shielded the gap 11 so as to isolate and protect an inner side of the receiving groove 31. A paste is applied between an inner wall of the receiving groove 31 and a peripheral of the base 1 and between the gap 11 and the convex plate 21 of the pin 2 for fastening.

Besides, another relay device of the present invention may comprise a base 1, a pin 2, and an outer cap 3. The base 1 has a gap 11 arranged at a peripheral thereof. The base 1 is combined with a electromagnet 12 and a control mount 13. The electromagnet 12 has a magnetic end 121 and one end arranged distant from the base 1. The control mount 13 has a covering hole 131 and a control portion 132. The covering hole 131 of the control mount 13 is covered the magnetic end 121. The control portion 132 includes an upper connection sheet 133 and a lower connection pad 134. The lower connection pad 134 is connected to a lower side of the upper connection sheet 133. And the lower connection pad 134 is connected with a second pin 135. The pin 2 has a convex plate 21. The pin 2 is assembled to the gap 11 of the base 1 and one end thereof is protruded from the gap 11. The convex plate 21 is covered the gap 11. The pin 2 includes a bent section 22 extended toward the control mount 13. The bent section 22 has a magnetic sheet 221 corresponding to the magnetic end 121 and a free connection pad 222 arranged between the upper connection sheet 133 and the lower connection pad 134. The bent section 22 has a bending elasticity so that the free connection pad 222 is elastically abutted against the upper connection sheet 133. The magnetic end 121 is magnetically abutted against the magnetic sheet 221 of the bent section 22 so that the free connection pad 222 is abutted against the lower connection pad 134 and electrically connected with a circuit via the second pin 135. The outer cap 3 has a receiving groove 31. The receiving groove 31 is covered the base 1 and packaged parts of the pin 2. A paste is applied between an inner wall of the receiving groove 31 and a peripheral of the base 1 and between the gap 11 and the convex plate 21 of the pin 2 for fastening.

Figure 2:
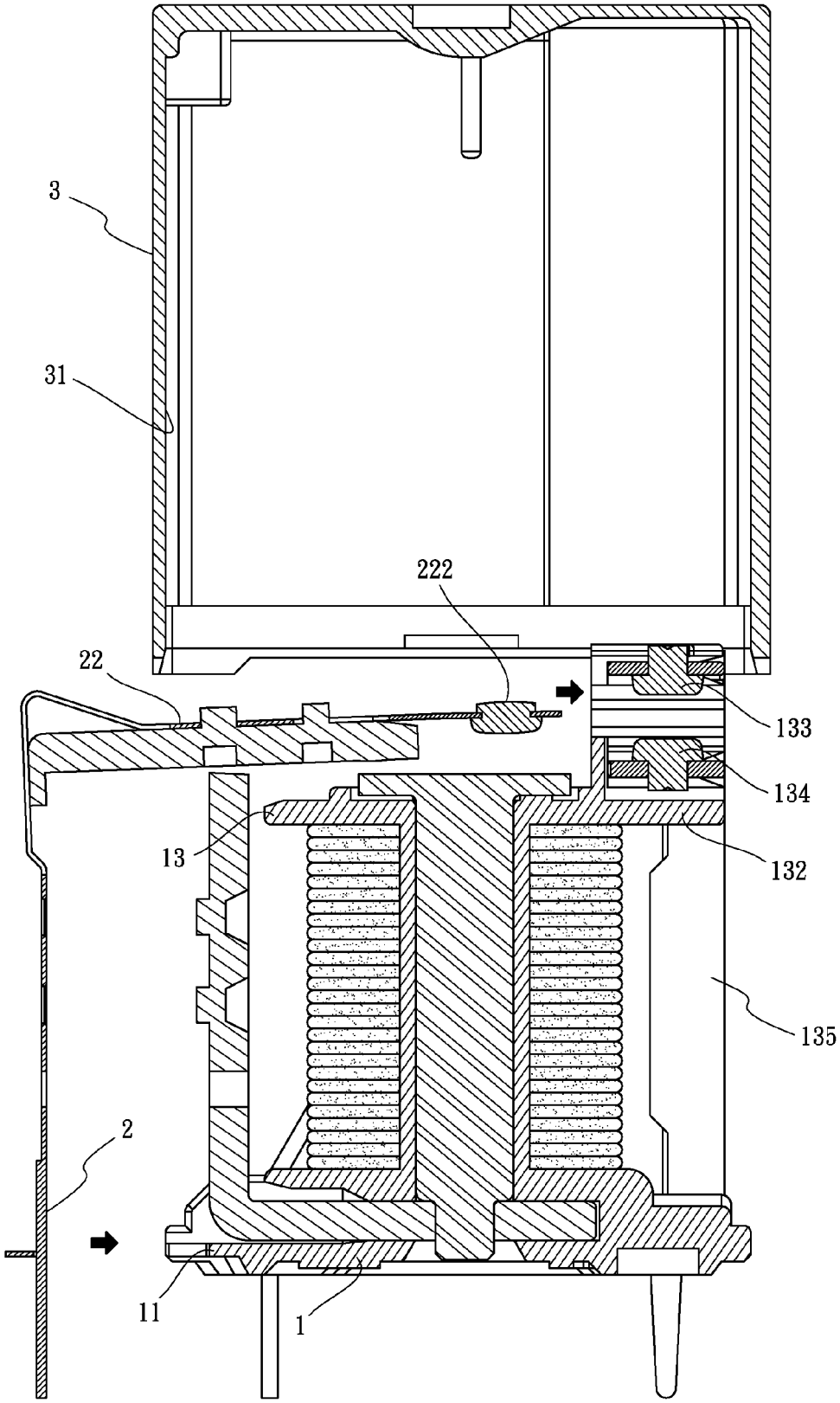
FIG. 2 is a cross-sectional view of the relay device of the present invention while in operation.

FIG. 2 is a cross-sectional view of the relay device of the present invention while in operation. The gap 11 of the base 1 may provide the pin 2 to assemble in unspecified directions so that the pin 2 may be assembled to the gap 11 of the base 1 along the arrow direction in FIG. 2. At the same time, the bent section 22 of the pin 2 and the free connection pad 222 may be inserted into the position between the upper connection sheet 133 and the lower connection pad 134 with the same direction so that the base 1 and the pine 2 may be assembled together once in an automatic machine. And then, the receiving groove 31 of the outer cap 3 is covered/assembled to the base 1 and the pin 2 to form the structure in FIGS. 3 to 5. And a paste may be applied among the peripheral of the base 1, the convex plate 21 of the pin 2, and a notch of the receiving groove 31 for fastening so as to finish the assembly of the relay device.

According to above mentioned, The gap 11 of the base 1 provides the pin 2 to assemble in unspecified directions so that it is advantageous to make the assembly of the base 1 and the pin 2 in the automatic machine may be finished once. And, the convex plate 21 of the pin 2 may cover/shield the gap 11 to isolate and protect the inner side of the receiving groove 31 while the convex plate 21 of the pin 2 is assembled to the gap 11. At the same time, it may also prevent the paste from overflowing into the receiving groove 21 of the outer cap 3 while being applied the paste.

Figure 3:
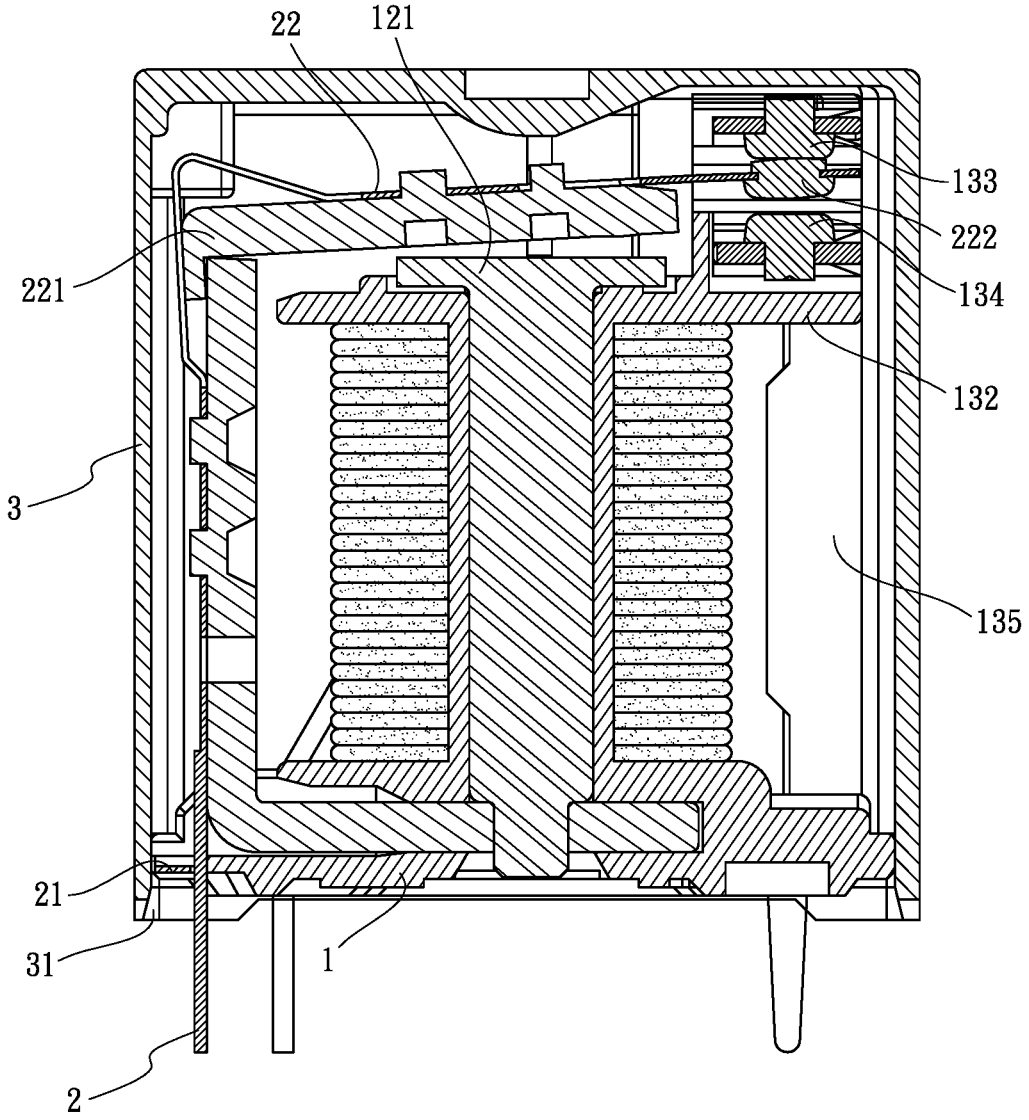
FIG. 3 is a cross-sectional view of FIG. 4 along line III-III.
Figure 4:
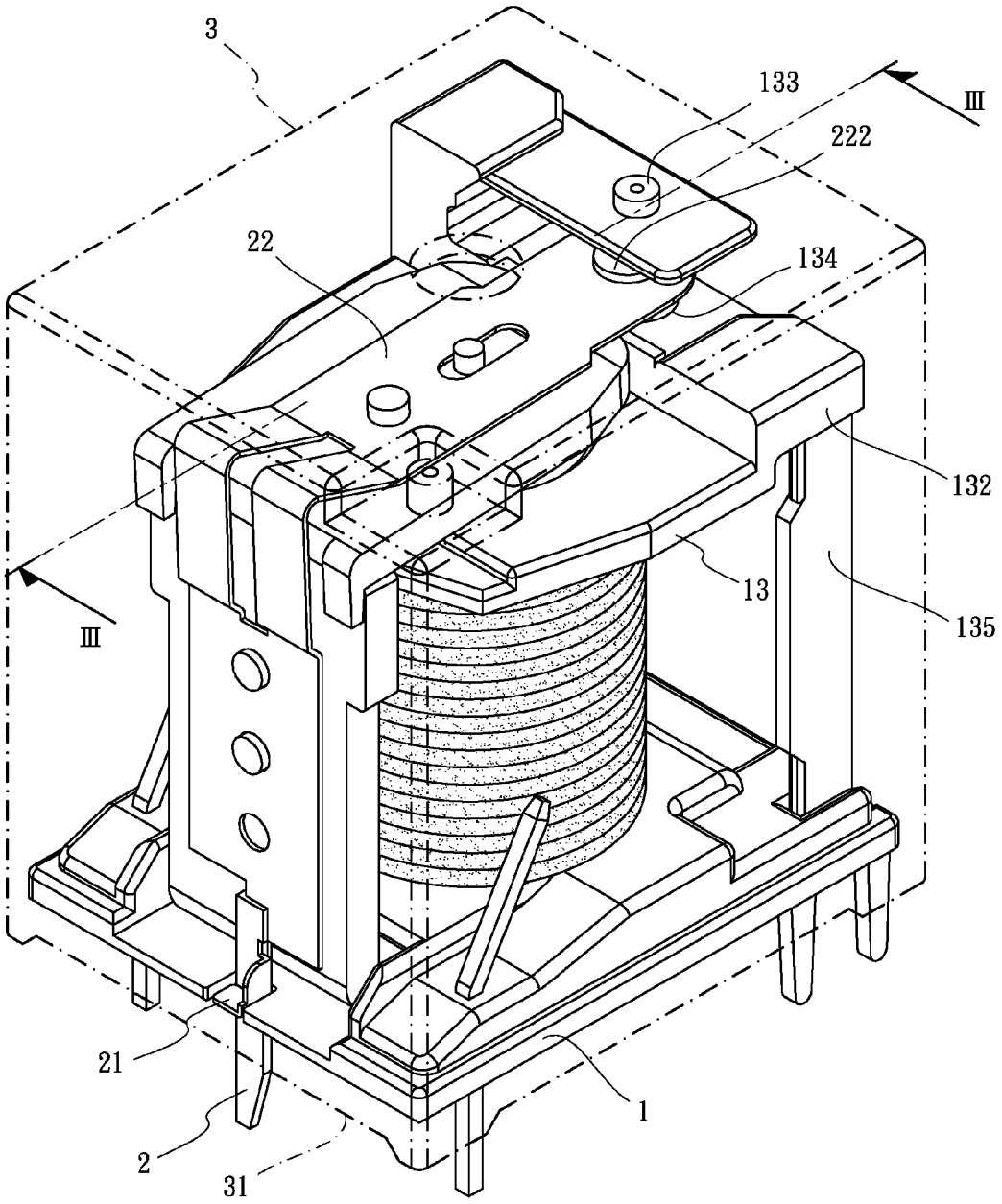
FIG. 4 is a perspective view of the relay device of the present invention.
Figure 5:
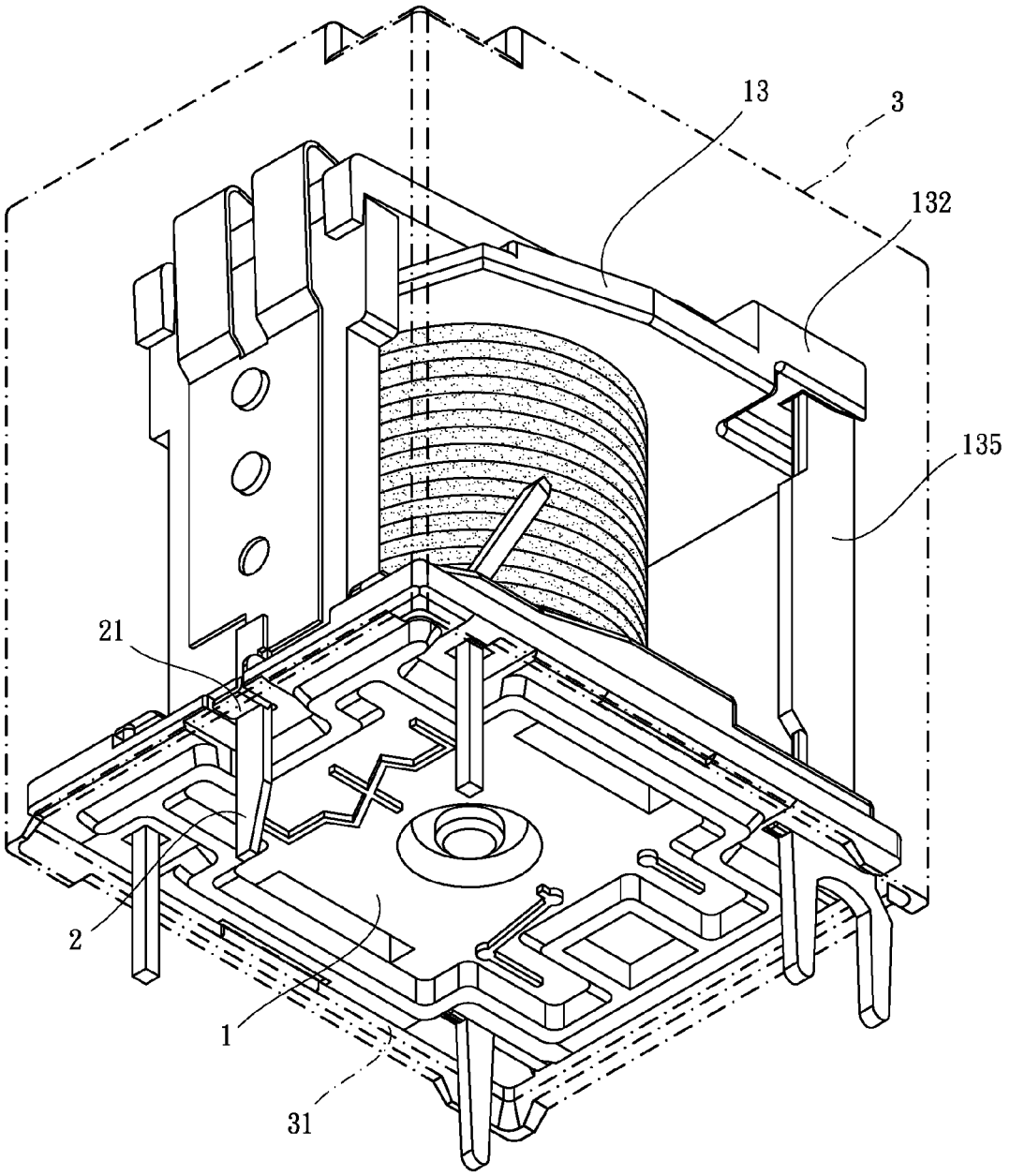
FIG. 5 is a perspective view of the relay device of the present invention viewed from another angle.
Figure 6:
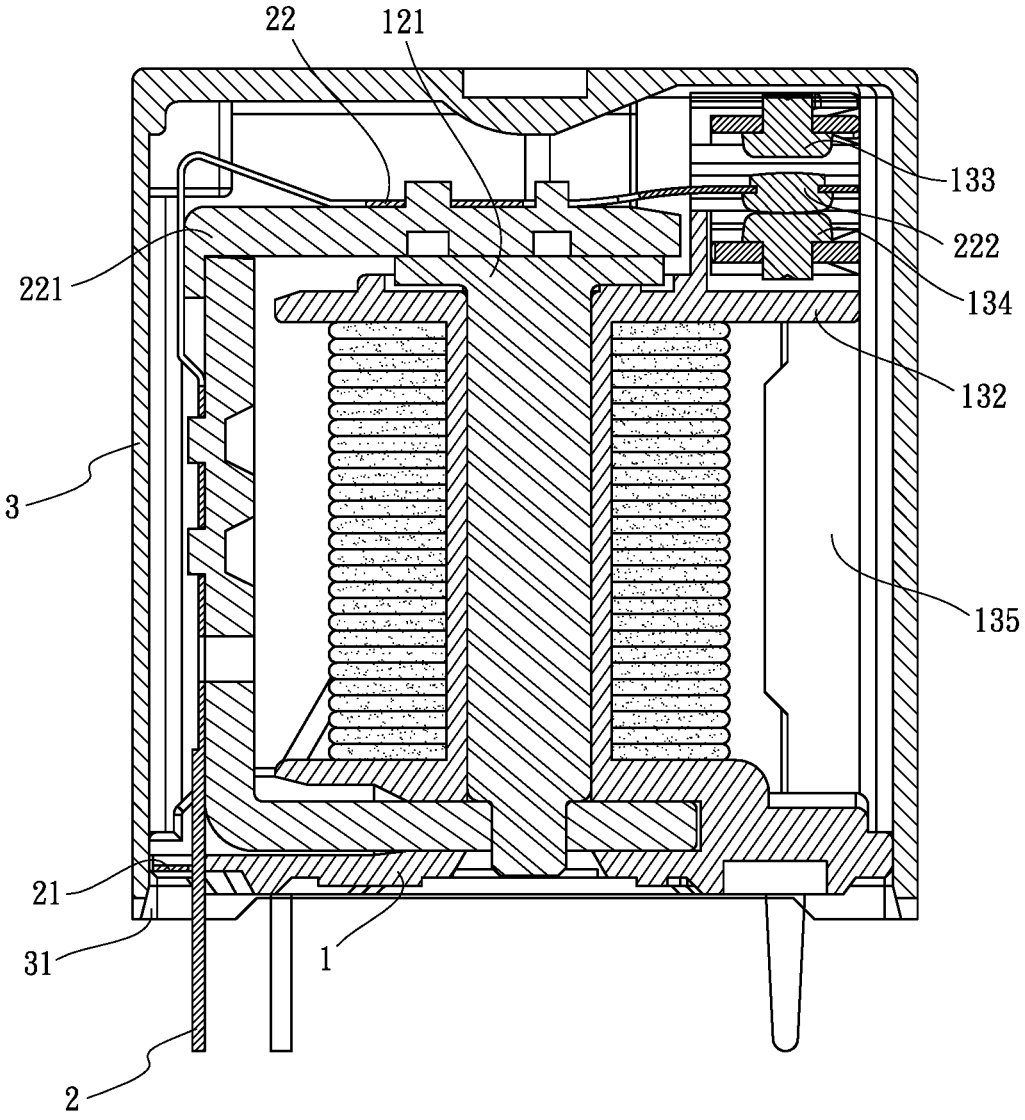
FIG. 6 is a cross-sectional view of the relay device of the present invention while electrically connecting with a second pin.
Figure 7:
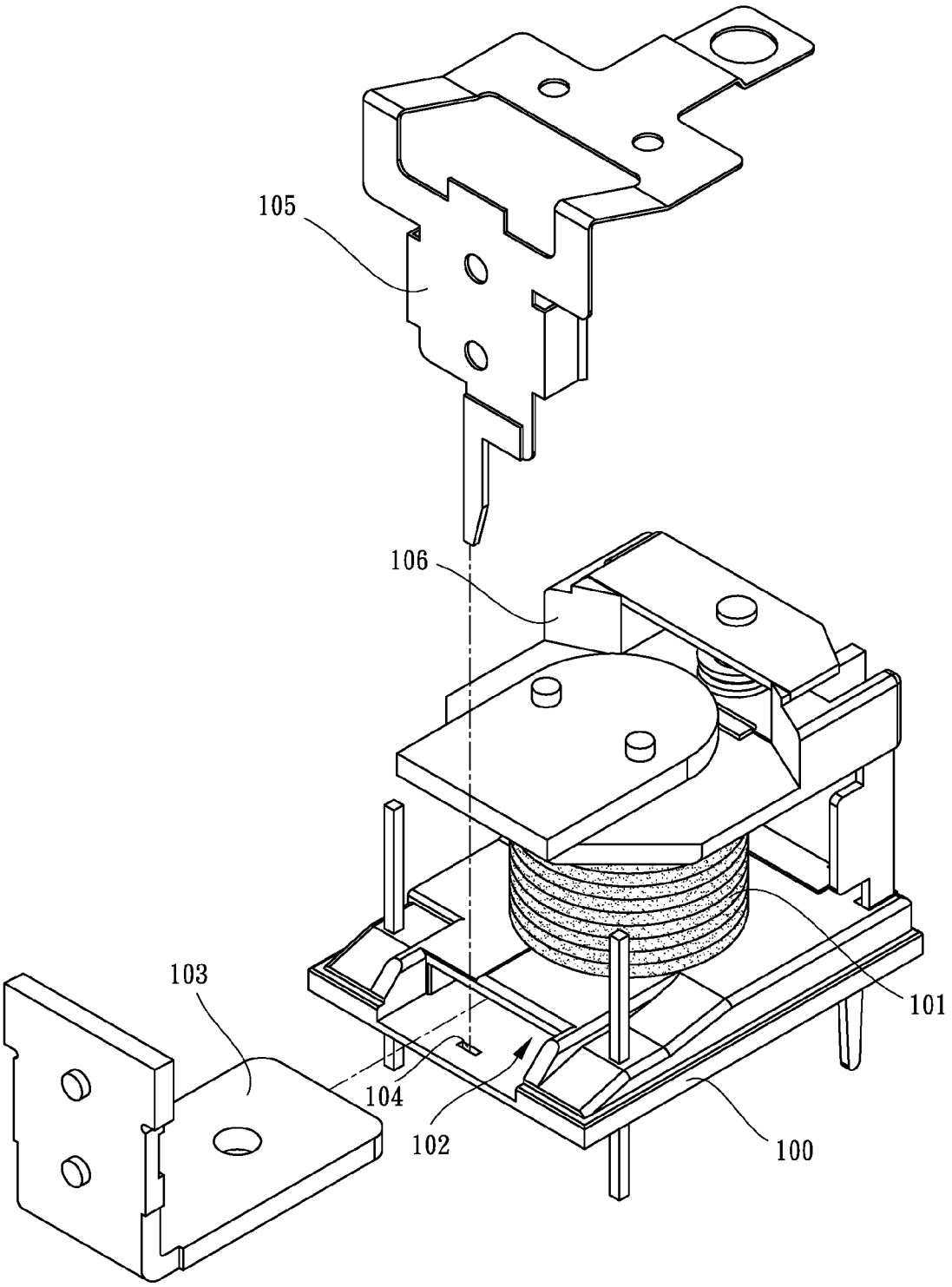
Prior Art FIG.7
FIG. 7 is a perspective view of a conventional relay device.

In the structure of FIG. 3, the bent section 22 of the pin 2 has the bending elasticity in normal status so that the free connection pad 222 is elastically abutted against the upper connection sheet 133. In FIG. 6, when the magnetic end 121 is magnetically abutted against the magnetic sheet 221 of the bent section 22, the free connection pad 222 is abutted against the lower connection pad 134 and electrically connected with a circuit via the second pin 135. The magnetic end 121 is elastically abutted against and released from the magnetic sheet 221 of the bent section 22 so that the free connection pad 222 is abutted against and left from the lower connection pad 134. It may achieve the control of the short or open of the circuit of the second pin 135.

In FIG. 1, it is worth mentioning that the convex plate 21 may be arranged at any side of the pin 2. A bent extending sheet 211 may be arranged at one side of the convex plate 21. The bent extending sheet 211 may be bent upwardly or downwardly (not shown). Besides, two bent extending sheets (211, show one side only) may be respectively arranged at two sides of the convex plate 21.

According to above descriptions, the gap 11 is arranged at the peripheral of the base 1 and the pin 2 for assembling to the base 1 has the convex plate 21 for covering/shielding the gap 11 so as to truly solve the problems/drawbacks of the technical development of the relay device. The advantages may be described as follows.

Firstly, the gap 11 arranged at the peripheral of the base 1 is provided the pin 2 for assembling in unspecific directions and advantageous to the once assembly of the base 1 and the pin 2 in the automatic machine. It may effectively simplify the process of assembling the relay device.

Secondly, the manufacturing process is simplified so that the manufacturing time may be precisely controlled to effectively reduce the cost and time and achieve the economic benefit.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. A relay device comprising:

a base having a gap arranged at a peripheral thereof, the base combined with an electromagnet and a control mount, the electromagnet having a magnetic end and one end arranged distant from the base, the control mount having a covering hole and a control portion, the magnetic end extending through the covering hole of the control mount, the control portion including an upper connection sheet and a lower connection pad, the lower connection pad connected to a lower side of the upper connection sheet, and the lower connection pad connected with a second pin;

a pin having a convex plate, the pin assembled to the gap of the base and one end thereof protruded from the gap, the gap being covered by the convex plate, the pin including a bent section extending toward the control mount, the bent section having a magnetic sheet corresponding to the magnetic end and a free connection pad arranged between the upper connection sheet and the lower connection pad, the bent section having a bending elasticity so that the free connection pad is elastically abutted against the upper connection sheet, the magnetic end being magnetically abutted against the magnetic sheet of the bent section so that the free connection pad is abutted against the lower connection pad and electrically connected with a circuit via the second pin; and an outer cap having a receiving groove, the receiving groove covering the base and packaged parts of the pin, and a paste applied between an inner wall of the receiving groove and a peripheral of the base and between the gap and the convex plate of the pin for fastening.

* * * * *